US006403274B2

(12) United States Patent
Tomita et al.

(10) Patent No.: US 6,403,274 B2
(45) Date of Patent: Jun. 11, 2002

(54) ELECTROPHOTOGRAPHIC TONER, PROCESS FOR PREPARING THE SAME, AND TWO-COMPONENT DEVELOPER

(75) Inventors: Kazufumi Tomita; Hiroyuki Tanaka; Hirotaka Matsuoka; Teigen Lee; Seiichi Takagi, all of Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/828,915

(22) Filed: Apr. 10, 2001

(30) Foreign Application Priority Data

Apr. 21, 2000 (JP) ..... 2000-121160

(51) Int. Cl.[7] ..... G03G 9/00
(52) U.S. Cl. ..... 430/110.3; 430/108.1
(58) Field of Search ..... 430/110.3, 108.1

(56) References Cited

U.S. PATENT DOCUMENTS 2,297,691 A 10/1942 Carlson
3,666,363 A 5/1972 Tanaka et al.
6,063,535 A * 5/2000 Tsutsui et al. ..... 430/102

FOREIGN PATENT DOCUMENTS

| | | |
|---|---|---|
| JP | A 56-1946 | 1/1981 |
| JP | A 63-259575 | 10/1988 |
| JP | A 10-268569 | 10/1998 |
| JP | A 11-44969 | 2/1999 |

* cited by examiner

*Primary Examiner*—Mark Chapman
(74) *Attorney, Agent, or Firm*—Oliff & Berridge, PLC

(57) ABSTRACT

An electrophotographic toner excellent in coloring property, fixing property, OHP transmittance and charging property, a process for producing the same, and a two-component developer are provided. The electrophotographic toner contains at least a binder resin, a colorant, a releasing agent and inorganic fine particles, in which the toner has a conglobation degree of about from 100 to 130, the releasing agent has an average particle diameter of about from 0.1 to 1 $\mu$m, a ratio of a major axis and a minor axis of about from 1.1 to 10, and the inorganic particles are dispersed in the toner particles.

17 Claims, No Drawings

ELECTROPHOTOGRAPHIC TONER, PROCESS FOR PREPARING THE SAME, AND TWO-COMPONENT DEVELOPER

FIELD OF THE INVENTION

The present invention relates to a toner for developing an electrostatic image of an electrophotographic process, a process for preparation of the same, and a two-component toner.

BACKGROUND OF THE INVENTION

Various processes have been know as an electrophotographic process as described in U.S. Pat. Nos. 2,297,691 and 3,666,363, and in general, it is constituted by basic steps including an exposing step of forming an electric latent image on a photosensitive layer utilizing a photoconductive substance by various means, a step of developing with a toner, a step of transferring the toner to a recording material, such as paper, a step of fixing the toner image to the recording material by heating, pressure heat and pressure, or vapor of a solvent, a step of removing a toner remaining on a photosensitive layer.

In recent years, a duplicator or a printer using an electrophotographic process is being demanded to have a moderate price and a small size, and it is important to simplify a fixing process to design that kind of duplicators and printers. As a method for fixing a toner to paper, a heat roll fixing method is currently employed as the most popular method.

A monochrome duplicator or printer generally uses a system, in which oil need not be supplied to a fixing device (heat roll) (hereinafter sometimes referred to as "oilless fixing"), but with respect to a color toner, a unit for supplying an oil is necessary to prevent offset to the roll, and it becomes a factor of inhibiting the design of a system having a small size and a moderate price. This is because in a full color system, which requires to provide a multi-color image of clear colors using cyan, yellow and magenta toners among color toners, the respective toner layers must be sufficiently fused, and the fixing temperature of the heat roll must be increased to a value above the temperature at which fixing to paper is generally conducted. The fixing characteristics that should be owned by the color toner are extremely important in a color electrophotographic image that requires such a process that plural numbers of development are conducted to superpose several kinds of toner layers having different colors on the same support as the fixing step. That is, the fixed color toner necessarily has diffused reflection due to toner particles that is suppressed as possible to have moderate gloss. Polyester having sufficient flexibility even when it has a low molecular weight is often employed in a toner as a resin that is quickly fused on fixing to form a smooth image surface. However, since the polyester resin for a color toner having a small internal cohesive force is difficult to be released from the roll on fusing, it is important in a color toner using polyester to provide a toner that solves offset at high temperatures or is free of oil coating, and thus a releasing agent such as wax is necessarily contained in the color toner.

However, when a considerable amount of wax is used, a such problem arises that transmittance of a transparency for an OHP is decreased or unevenness is formed on color formation due to fusing unevenness of wax or unevenness of wax remaining on a heat roll caused by lapse of time, and another problem arises in that the toner is liable to be broken when the toner is agitated in a developing device to attain sufficient charge. On the other hand, a toner using a small amount of wax having a low melting point can be produced by a so-called submerged drying process, in which an oleophilic component liquid having a toner component dissolved therein is formed into particles in an aqueous medium, and is powdered after removing the solvent. However, a finger is necessarily provided in the fixing device to forcedly peel the fixed image support for preventing involution, and when the fixing temperature is increased to obtain sufficient coloring, a problem is caused in that it is liable that the fixed image is in contact with the peeling finger to deteriorate image quality.

SUMMARY OF THE INVENTION

The invention is to solve the problems associated with the conventional techniques to provide an electrophotographic toner excellent in coloring property, fixing property, OHP transmittance and charging property, a process for producing the same, and a two-component developer.

According to an aspect of the invention, the electrophotographic toner contains at least a binder resin, a colorant, a releasing agent and inorganic fine particles, in which the toner has a conglobation degree of about from 100 to 130, the releasing agent has an average particle diameter of about from 0.1 to 1 $\mu$m, a ratio of a major axis and a minor axis of about from 1.1 to 10, and the inorganic fine particles are dispersed in the toner particles.

According to another aspect of the invention, the process for producing the electrophotographic toner of the invention contains,

- a step of mixing a binder resin, a colorant, a releasing agent and inorganic fine particles in an organic solvent that dissolves the binder resin to prepare an oleophilic component,
- a step of suspending the oleophilic component in an aqueous medium and forming into particles, to prepare a suspension, and
- a step of removing the organic solvent from the suspension.

According to still another aspect of the invention, the two-component developer contains a carrier and a toner, in which the toner is the electrophotographic toner according to the invention.

DETAILED DESCRIPTION OF THE INVENTION (Electrophotographic Toner)

The electrophotographic toner of the invention contains at least a binder resin, a colorant, a releasing agent and inorganic fine particles, and the toner has a conglobation degree of about from 100 to 130, and the releasing agent has an average particle diameter of about from 0.1 to 1 $\mu$m and a ratio of a major axis and a minor axis of about from 1.1 to 10. Since the electrophotographic toner of the invention has the specific conglobation degree, and the releasing agent has the specific average particle diameter and the specific major axis/minor axis ratio, it is excellent in a coloring property, a fixing property, an OHP transmittance and a charging property, and particularly, it can be easily released from a fixing device, such as a fixing roll, so as to provide an excellent coloring property (reproducibility) of additive colors. The materials will be described in detail below.

As the binder resin, known resins for fixing can be used, and specific examples thereof include polyester obtained by condensation polymerization of an alcohol component and a carboxylic acid component (examples of the alcohol component include a two or more valent alcohol and a derivative thereof, such as ethylene glycol, diethylene glycol, triethylene glycol, polyethylene glycol, propylene glycol, butanediol, pentanediol, hexanediol, cyclohexane dimethanol, xylylene glycol, dipropylene glycol, polypropylene glycol, bisphenol A, hydrogenated bisphenol A, bisphenol A ethyleneoxide, bisphenol A propyleneoxide, sorbitol and glycerin, and examples of the carboxylic acid component include a two or more valent carboxylic acid, a carboxylic acid derivative and a carboxylic anhydride, such as maleic acid, fumaric acid, phthalic acid, isophthalic acid, terephthalic acid, fumaric acid, adipic acid, trimellitic acid, pyromellitic acid, cyclopentane dicarboxylic acid, succinic anhydride, trimellitic anhydride and dodecenyl succinic anhydride, provided that the alcohol component and the carboxylic acid component each may be a combination of two or more of them), an acrylate polymer (for example, polymethyl acrylate, polyethyl acrylate, polybutyl acrylate, poly-2-ethylhexyl acrylate and polylauryl acrylate), a methacrylate polymer (for example, polymethyl methacrylate, polyethyl methacrylate, polybutyl methacrylate, poly-2-ethylhexyl methacrylate and polylauryl methacrylate), a copolymer of an acrylate and a methacrylate, a copolymer of a styrene series monomer and an acrylate or a methacrylate, an ethylene series polymer (for example, polyvinyl acetate, polyvinyl propyonate, polyvinyl butyrate, polyethyelne and polypropylene) and a copolymer thereof, a styrene series polymer (for example, a styrene-butadiene copolymer, a styrene-isoprene copolymer and a styrene-maleic acid copolymer), polyvinyl ether, polyvinyl ketone, polyester, polyamide, polyurethane, rubber, an epoxy resin, polyvinyl butyral, rosin, modified rosin, a terpene resin and a phenol resin. Among these, polyester is particularly preferred. These may be used singly or in combination of two or more.

The binder resin preferably has a mechanical tangent loss (tan δ) of dynamic viscoelasticity, at an angular velocity of 100 rad/sec and a temperature of 130° C., of from 1.8 to 3.3, more preferably from 2.5 to 3.0, and particularly preferably from 2.7 to 2.9. When the mechanical tangent loss (tan δ) is less than 1.8, the gloss of the fixed image may be low to deteriorate the coloring property. When it exceeds 3.3, involution of a transfer medium (such as paper) on a fixing device is liable to occur. Therefore, when the mechanical tangent loss (tan δ) is in the range, both the coloring property and the fixing property can be accomplished.

The mechanical tangent loss (tan δ) herein is a value obtained by dividing a loss modulus (G") by a storage modulus (G'), and can be measured, for example, by Rheometer RDA2 produced by Rheometric Scientific, Inc.

As the colorant, known pigments may be used. Examples of the pigment include known organic or inorganic pigments, and examples thereof include carbon black (for example, furnace black, channel black, acetylene black and thermal black), an inorganic pigment (for example, red iron oxide, Prussian blue and titanium oxide), an azo pigment (for example, fast yellow, disazo yellow, pyrazolone red, chelate red, brilliant carmine, parabrown and benzimidazolone), a phthalocyanine pigment (for example, copper phthalocyanine and non-metallic phthalocyanine), a condensed polycyclic pigment (for example, flavantron yellow, dibromoanthrone orange, perylene red, quinacridone red and dioxane violet), and a carmine lake pigment.

As the pigment, C.I. Pigment Yellow 93, C.I. Pigment Yellow 180, C.I. Pigment Blue 15:3, C.I. Pigment Blue 15:4, C.I. Pigment Red 122, C.I. Pigment Red 57:1, C.I. Pigment Red 185 and carbon black are preferred from the standpoint of reproducibility of additive colors.

The pigment is preferably used in combination with a pigment dispersant to stably maintain the dispersion state thereof. Specific examples of the pigment dispersant include EFKA47, EFKA4009 and EFKA4010 (modified polyurethane, produced by EFKA Chemicals, Inc.), Ajisper PB711, Ajisper PB411 and Ajisper PA111 (Produced by Ajinomoto Co., Inc.), and Disparlon DA-703-50, Disparlon DA-705, Disparlon DA-725 and Disparlon DA-400N (polyester, produced by Kusumoto Chemicals, Ltd.).

It is preferred to use the pigment in combination with a pigment derivative, or to use a pigment having been subjected to a surface treatment, in order to firmly bond to the pigment dispersant to further stabilize the dispersed state of the pigment. Specific examples of the pigment derivative include dimethylaminoethylquinacridone, dihydroquinacridone, a sulfonic acid derivative of anthraquinone, a carboxylic acid derivative of anthraquinone, Solsperse 5000, Solsperse 12000, Solsperse 22000 (produced by Zeneca, Ltd.), EFKA-745 and LP6750 (produced by EFKA Chemicals, Inc.). Examples of the surface treating agent of the pigment include natural rosin (for example, gum rosin, wood rosin and tall rosin), an abietic acid derivative (for example, abietic acid, levopimaric acid and dextropimaric acid), a metallic salt thereof (for example, a calcium salt, a sodium salt, a potassium salt and a magnesium salt), a rosin-maleic acid resin and a rosin-phenol resin. The amount of the pigment derivative and the pigment surface treating agent is preferably from 0.1 to 100% by weight based on the pigment, and more preferably from 0.1 to 10% by weight.

In the case where the electrophotographic toner of the invention is used as a magnetic one-component toner, the whole or part of the black colorant may be replaced with magnetic powder. Examples of the magnetic powder include an elemental substance of a metal, or magnetite, ferrite, or cobalt, iron or nickel and alloys thereof.

The content of the colorant is preferably from 1 to 50 parts by weight per 100 parts by weight of the binder resin, and more preferably from 2 to 20 parts by weight.

The releasing agent has an average particle diameter (dispersion diameter) of about from 0.1 to 1 μm, and preferably from 0.3 to 0.8 μm. When the average particle diameter is less than 0.1 μm, the releasing agent cannot effectively act on fixing to cause involution of the transfer medium on the fixing device. When it exceeds 1 μm, the OHP transmittance and the coloring property are lowered.

The average particle diameter of the releasing agent is calculated by such a manner that 50 images of the releasing agent fine particles magnified at 10,000 times are randomly sampled by observation of the cross section of the toner with a transmitting electron microscope, each of which are measured for (major diameter of releasing agent+minor diameter)/2, and an average value of the 50 samples is designated as the average particle diameter.

The releasing agent has a ratio of the major diameter to the minor diameter of about from 1.1 to 10, and preferably from 1.2 to 5. When the major diameter/minor diameter ratio is less than 1.1, the releasing agent is difficult to ooze on fixing to cause involution of the fixing medium on the fixing device. When it exceeds 10, the OHP transmittance and the coloring property are lowered.

The major diameter/minor diameter ratio of the releasing agent is calculated by such a manner that 50 images of the releasing agent fine particles magnified at 10,000 times are randomly sampled by observation of the cross section of the toner with a transmitting electron microscope, each of which are measured for the major diameter/minor diameter ratio, and an average value of the 50 samples is designated as the average particle diameter.

Examples of the method for forming the releasing agent into fine particles include a method, in which the releasing agent is subjected to wet pulverization in an organic solvent with a media mill to form fine particles; a method, in which after dissolving the releasing agent in an organic solvent, it is subjected to precipitation by cooling, so as to form fine particles; and a method, in which the releasing agent is evaporated in a gaseous phase to form fine particles. The organic solvent used herein is not necessarily the same as the organic solvent used for dissolving the binder resin described later. The amount of the organic solvent is preferably from 0.1 to 20 parts by weight per 1 part by weight of the releasing agent. The releasing agent may be dissolved by heating or application of pressure. In the method of evaporating the releasing agent in a gaseous phase to form fine particles, an inert gas, such as helium, argon and nitrogen, is used as the gaseous phase, in which the releasing agent is heated to a temperature of from 100 to 400° C. and evaporated under reduced pressure at from 1.333 to 1333 Pa (from 0.01 to 10 torr), and the releasing agent fine particles thus evaporated are attached to a cooled substrate and are scraped out or dispersed in a solvent, so as to obtain fine particles having a specific shape. In this method, a fraction having a narrow molecular weight distribution can be separated by adjusting the temperature and the degree of reduced pressure.

Specific examples of the releasing agent include petroleum wax (for example, paraffin wax, oxidized paraffin wax and microcrystalline wax), a mineral wax (for example, montan wax), animal or vegetable wax (for example, bees wax and carnauba wax), and synthetic wax (for example, polyolefin wax, oxidized polyolefin wax and Fischer-Tropsch wax). Among these, paraffin wax is preferred. The releasing agent may be used singly or in combination of two or more of them.

The releasing agent preferably has a melting point of from 50 to 110° C., and more preferably from 60 to 100° C. In particular, paraffin wax having a melting point of from 50 to 110° C. is preferred as the releasing agent.

The content of the releasing agent is preferably about from 0.5 to 10 parts by weight per 100 parts by weight of the binder resin, and more preferably from 1 to 7 parts by weight.

Examples of the inorganic fine particle include a metallic salt (for example, calcium carbonate, tricalcium phosphate and barium sulfate), a metallic oxide (for example, silicon oxide, titanium oxide, aluminum oxide, barium titanate, strontium titanate, calcium titanate, cerium oxide, zirconium oxide and magnesium oxide), and ceramics. Among these, inorganic fine particles having a small difference in refractive index from the binder resin, such as silicon oxide, excellent in coloring property and OHP transmittance are preferred. The inorganic fine particles may be used as a single species or in combination of two or more species thereof. The inorganic fine particles herein are those contained inside the toner particles, i.e., those subjected to so-called internal addition.

When the inorganic fine particles have a small oleophilic property, the degree of incorporation into the toner particles is liable to be decreased, and therefore it is preferred to use those having been subjected to a surface treatment to have a hydrophobic property to prevent drop off from the toner particles during the production process. Examples of the surface treating agent attaining a hydrophobic property include a coupling agent. Specific examples of the coupling agent include a silane coupling agent, such as methyltrichlorosilane, ethyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenylethoxysilane, isobutyltrimethoxysilane, decyltrimethoxysilane, hexamethylsilazane, N,N-bis(trimethylsilyl)acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3.4epoxycyclohexyl)ethyltrimethoxysilane, γ-glycidoxypropyltrimethoxysilane, γ-glycidoxypropylmethyldiethoxysilane, γ-mercaptopropyltrimethoxysilane and γ-chloropropyltrimethoxysilane, and a titanium coupling agent. In particular, it is preferred to use silicon oxide having been subjected to a treatment attaining a hydrophobic property, as the inorganic fine particles.

The inorganic fine particles preferably have an average particle diameter of from 4 to 500 nm, and more preferably from 6 to 50 nm. When the particle diameter is outside the range, there are cases where a sufficient fixing property cannot be obtained.

The content (amount of internal addition) of the inorganic fine particles is preferably from 1 to 20 parts by weight per 100 parts by weight of the toner, and particularly preferably from 2 to 10 parts by weight. The content is outside the range, there are cases where a sufficient fixing property cannot be obtained.

The electrophotographic toner of the invention has a conglobation degree of about from 100 to 130, and preferably from 100 to 120. When the conglobation degree exceeds 130, the contact area of the toner with the photoreceptor is increased to lower the transferring property, and the good coloring property, particularly reproducibility of additive colors, is deteriorated. Furthermore, involution of the fixing medium on the fixing device occurs, which is considered to be because the shape of the toner becomes ununiform to cause scattering in melting temperature of the toner.

The conglobation degree herein is calculated by such a manner that 100 toner images magnified at 500 times are randomly sampled by using, for example, FE-SEM (S=800) produced by Hitach, Ltd., and the image information is introduced into, for example, an image analyzer produced by Nireco Corp. (Luzex III) via an interface to conduct analysis, followed by obtaining a value (shape factor MSL2) calculated by the following equation (1), an average value of which is then obtained. A shape of a toner produced by an ordinary kneading and pulverization process is irregular, and the MSL2 thereof is about from 140 to 160.

$$\text{MLS2}=(\text{maximum length of toner particle})2\ /(\text{projected area of toner particle})\times\pi\times\tfrac{1}{4}\times 100 \quad (1)$$

The electrophotographic toner of the invention preferably has a maximum value of a mechanical tangent loss (tan δ) of dynamic viscoelasticity, at an angular velocity of 100 rad/sec and a temperature, of from 130 to 190° C. of 2.1 or less, and more preferably 1.7 or less. When the maximum value of the mechanical tangent loss (tan δ) of dynamic viscoelasticity exceeds 2.1, involution of the fixing medium on the fixing device is liable to occur, and deterioration of the image is liable to occur due to a trace of a peeling claw. The mechanical tangent loss (tan δ) herein has been described in the foregoing.

The electrophotographic toner of the invention preferably has an average particle diameter of from 3 to 10 μm. The average particle diameter is a value measured by using a particle diameter measuring apparatus, Multisizer (aperture diameter: 50 μm, volume average diameter), produced by Beckman Coulter, Inc.

The electrophotographic toner of the invention may contain, in addition to the foregoing materials, a charge controlling agent (internal additive) and inorganic fine particles (external additive).

As the charge controlling agent, those having been used in a developer may be used, and specific examples thereof include a compound used in a powder toner for xerography selected from the group consisting of a metallic salt of benzoic acid, a metallic salt of salicylic acid, a metallic salt of alkylsalicylic acid, a metallic salt of catechol, a metal-containing bisazo dye, a tetraphenylborate derivative, a quarternary ammonium salt and an alkylpyridinium salt, a resin type charge controlling agent containing a polar group, and a combination thereof. In general, the addition amount (internal addition amount) of the charge controlling agent is preferably about 10% by weight or less based on the solid content of the toner.

The inorganic fine particles (external additive) are added to the surface of the toner to impart fluidity to the toner, and the specific examples thereof include a metallic salt, a resin, a metallic oxide, such as silicon oxide, titanium oxide, aluminum oxide, barium titanate, strontium titanate, calcium titanate, cerium oxide, zirconium oxide and magnesium oxide, ceramics, and carbon black.

The inorganic fine particles (external additive) are preferably subjected to a surface treatment to have a hydrophobic property for controlling the charging property thereof. Examples of the surface treating agent attaining a hydrophobic property include a coupling agent. Specific examples of the coupling agent include those described in the foregoing.

The electrophotographic toner of the invention can be applied to an image forming apparatus and an image forming process having a system, in which oil need not be supplied to a fixing device (heat roll), i.e., a so-called oilless fixing system.

The electrophotographic toner of the invention may be obtained by any manner without limitation as far as the necessary factors, such as the conglobation degree and the average particle diameter of the releasing agent, are satisfied, and is preferably produced by the process for producing an electrophotographic toner according to the invention, which will be described below.

(Process for Preparation of Electrophotographic Toner)

The process for preparation of an electrophotographic toner of the invention contains a step of mixing a binder resin, a colorant, a releasing agent and inorganic fine particles in an organic solvent that dissolves the binder resin to prepare an oleophilic component (hereinafter referred to as a mixing step), a step of suspending the oleophilic component in an aqueous medium and forming into particles, to prepare a suspension (hereinafter referred to as a suspending step), and a step of removing the organic solvent from the suspension (hereinafter referred to as a solvent removing step). As the respective materials, the same materials as described for the electrophotographic toner of the invention are used. Other steps may be conducted between the respective steps.

In the mixing step, a binder resin, a colorant dispersion, a releasing agent dispersion, inorganic fine particles and other additives depending on necessity are mixed with an organic solvent that dissolves the binder resin to prepare an oleophilic component. As the organic solvent, general organic solvents are used, and specific examples thereof include a hydrocarbon, such as toluene and xylene, a halogenated hydrocarbon, such as methylene chloride, chloroform and dichloroethane, an ether, such as tetrahydrofuran, an ester, such as methyl acetate, ethyl acetate and butyl acetate, and a ketone, such as methyl ethyl ketone and cyclohexanone. These organic solvents may be used singly or in combination of two or more of them.

In the mixing step, the colorant may be mixed as it is with the organic solvent along with the other components, but it is preferred to use a colorant dispersion having the colorant having been dispersed therein. The colorant dispersion can be obtained by dispersing the colorant in the organic solvent by using, for example, a media type disperser, such as a sand mill, a ball mill, an attritor and a co-ball mill, a roll mill, such as three-roll mill, a cavitation mill, such as a nanomizer, and a colloid mill. At this time, other additives, such as a pigment dispersant and a pigment derivative, are also dispersed depending on necessity. In order to apply a suitable shearing force on preparing the colorant dispersion, a part of the binder resin may be added to adjust the viscosity. The organic solvent used herein may not necessarily be the same as the organic solvent used on preparing the oleophilic component.

In the mixing step, the releasing agent used is preferably that formed into fine particles having the specific average particle diameter and the specific major diameter/minor diameter ratio as described in the foregoing, and while the releasing agent fine particles may be mixed as they are with the organic solvent along with the other components, a releasing agent dispersion having the releasing agent dispersed therein may also be used. The releasing agent dispersion can be obtained, as similar to the colorant, by dispersing the releasing agent having been formed into fine particles in an organic solvent. The organic solvent used herein may not necessarily be the same as the organic solvent used on preparing the oleophilic component.

In the mixing step, while the inorganic fine particles may be mixed as they are with the organic solvent along with the other components as similar to the colorant and the releasing agent, an inorganic fine particle dispersion having the inorganic fine particles dispersed therein may also be used. The inorganic fine particle dispersion may be obtained, for example, by dispersing the inorganic fine particles in an organic solvent, as similar to the colorant. The organic solvent used herein may not necessarily be the same as the organic solvent used on preparing the oleophilic component.

In the mixing step, a rotor stator type agitator, such as a homogenizer and a colloid mill, an impeller type agitator, such as a dissolver, and an ultrasonic agitator are used for mixing (agitation) upon preparation of the oleophilic component.

In the suspending step, the oleophilic component obtained through the mixing step is suspended in an aqueous medium and formed into particles to prepare a suspension. As the aqueous medium, water is mainly employed, and a water-soluble solvent may be used in combination. Examples of the water-soluble solvent include methyl alcohol, ethyl alcohol, acetone and ethyl acetate, and these may be used in a range where they are dissolved in water.

In the suspending step, a dispersion stabilizer is preferably used to stabilize the dispersion state of the oleophilic component in the aqueous medium. Examples of the dispersion stabilizer include inorganic fine particles and a water-soluble polymer. Examples of the inorganic fine particles include tricalcium phosphate, hydroxyapatite, calcium carbonate, titanium oxide, aluminum hydroxide, magnesium hydroxide, barium sulfate and silicon oxide. Examples of the water-soluble polymer include cellulose, hydroxypropylmethyl cellulose, methyl cellulose, carboxymethyl cellulose, starch, polyvinyl alcohol and polyacrylic acid. The amount of the dispersion stabilizer is preferably from 1 to 30 parts by weight per 100 parts by weight of the aqueous medium. The inorganic fine particles used as the dispersion stabilizer preferably have an average particle diameter of 1 $\mu$m or less.

In the solvent removing step, the organic solvent is removed from the suspension to obtain a toner in the form of particles. It is also possible that a poor solvent is added to the suspension to deposit the toner (particles), and then the organic solvent is removed. Examples of the poor solvent include methanol and ethanol.

The toner obtained through the foregoing steps is taken out, for example, by filtration, and then is generally subjected to washing with water, drying and classification. The drying is conducted by using a known apparatus, such as an aeration drying apparatus, a spray drying apparatus, a rotation drying apparatus, an air stream drying apparatus, a fluidized bed drying apparatus, a thermal transmission heating type drying apparatus and a freeze drying apparatus.

In the process for producing an electrophotographic toner according to the invention, an external additive, such as inorganic fine particles, is added depending on necessity. As for the method for adding the external additive, after drying the toner, the external additive may attached to the surface of the toner through a dry process by using a mixer, such as a V blender and a Henschel mixer, or in alternative, the external additive may be suspended in an aqueous medium to form particles, and then added to the toner in the form of a slurry (suspension), followed by drying to attach the external additive to the surface of the toner. Further in alternative, the toner in the form of slurry (suspension) may be sprayed and dried on the external additive, so as to attach the external additive to the surface of the toner.

According to the process for preparation of an electrophotographic toner of the invention, the electrophotographic toner of the invention can be obtained.

(Two-component Developer)

The two-component developer of the invention contains a carrier and the electrophotographic toner of the invention. The carrier is not particularly limited, and conventionally known ones can be employed.

The invention will be further described specifically with reference to the examples below. However, the invention is not construed as being limited to the examples.

EXAMPLE 1

75 parts by weight of C.I. Pigment Yellow 180, 412.4 parts by weight of ethyl acetate and 12.6 parts by weight of Disparlon DA-703-50 (an acid amide amine salt of polyester, produced by Kusumoto Chemicals, Ltd.), from which a solvent has been removed, are dissolved and dispersed by using a DCP mill to produce a pigment dispersion.

30 parts by weight of paraffin wax (melting point: 75° C.) and 270 parts by weight of ethyl acetate are pulverized by a wet process under the condition cooled to 5° C. by using a DCP mill to produce a wax (releasing agent) dispersion.

300 parts by weight of a polyester resin formed from a bisphenol A propylene oxide adduct, bisphenol A ethylene oxide adduct and a terephthalic acid derivative (Mw: 50,000, Mn: 3,000, acid value: 15 mgKOH/g, hydroxyl group value: 27 mgKOH/g, Tg: 65° C., softening point: 112° C., mechanical tangent loss at 130° C.: 2.8), 267 parts by weight of the pigment dispersion, 400 parts by weight of wax dispersion and 20 parts by weight of hydrophobic silicon oxide fine particles (R972 produced by Aerosil Co., Ltd., average particle diameter: 16 nm) are mixed and well agitated to become uniform (the liquid obtained is designated as a liquid A). Separately, 124 parts by weight of calcium carbonate dispersion formed by dispersing 40 parts by weight of calcium carbonate in 60 parts by weight of water, 99 parts by weight of a 2% aqueous solution of Celogen BS-H (produced by Dai-ichi Kogyo Seiyaku Co., Ltd.) and 157 parts by weight of water are agitated for 3 minutes by using a homogenizer (Ultra-Turrax, produced by IKA Works, Inc.) (the liquid obtained is designated as a liquid B).

345 parts by weight of the liquid B and 250 parts by weight of the liquid A are agitated at 10,000 rpm for 1 minute by using a homogenizer (Ultra-Turrax, produced by IKA Works, Inc.) to suspend the mixed solution, and then after adding 110 parts by weight of 0.3% aqueous ammonia, the solvent is removed by agitating with a propeller type agitator for 48 hours at room temperature and normal pressure. Hydrochloric acid is added to remove calcium carbonate, and then washing with water, drying and classification are conducted to obtain a toner.

1.3 parts by weight of silicone oil-treated silicon oxide fine particles having an average particle diameter of 40 nm (RY50, produced by Nippon Aerosil Co., Ltd.), 2 parts by weight of deflagration silicon oxide fine particles having an average particle diameter of 100 nm (KMP-105, a classified product produced by Shin-Etsu Chemical Co., Ltd.) and 1.5 parts by weight of fine particles obtained by treating titanium oxide having an average particle diameter of 20 nm (MT150AW, produced by Tayca Corp.) with 20% of decyltrimethoxysilane are mixed with 100 parts by weight of the toner in a sample mill to produce a mixed toner.

EXAMPLE 2

125 parts by weight of carbon black, 356.2 parts by weight of ethyl acetate and 18.8 parts by weight of Disparlon DA-703-50 (an acid amide amine salt of polyester, produced by Kusumoto Chemicals, Ltd.), from which a solvent has been removed, are dissolved and dispersed by using a DCP mill to produce a pigment dispersion.

30 parts by weight of paraffin wax (melting point: 89° C.) and 270 parts by weight of ethyl acetate are pulverized by a wet process under the condition cooled to 5° C. by using a DCP mill to produce a wax (releasing agent) dispersion.

425 parts by weight of a polyester resin formed from a bisphenol A propylene oxide adduct, bisphenol A ethylene oxide adduct and a terephthalic acid derivative (Mw: 50,000, Mn: 3,000, acid value: 15 mgKOH/g, hydroxyl group value: 27 mgKOH/g, Tg: 65° C., softening point: 112° C., mechanical tangent loss at 130° C.: 2.8), 100 parts by weight of the pigment dispersion, 250 parts by weight of wax dispersion and 25 parts by weight of hydrophobic silicon oxide fine particles (R812 produced by Aerosil Co., Ltd., average particle diameter: 7 nm) are mixed and well agitated to become uniform (the liquid obtained is designated as a liquid A). Separately, 124 parts by weight of calcium carbonate dispersion formed by dispersing 40 parts by weight of calcium carbonate in 60 parts by weight of water, 99 parts by weight of a 2% aqueous solution of Celogen BS-H (produced by Dai-ichi Kogyo Seiyaku Co., Ltd.) and 157 parts by weight of water are agitated for 3 minutes by using a homogenizer (Ultra-Turrax, produced by IKA Works, Inc.) (the liquid obtained is designated as a liquid B).

345 parts by weight of the liquid B and 250 parts by weight of the liquid A are agitated at 10,000 rpm for 1 minute by using a homogenizer (Ultra-Turrax, produced by IKA Works, Inc.) to suspend the mixed solution, and then after adding 110 parts by weight of 0.3% aqueous ammonia, the solvent is removed by agitating with a propeller type agitator for 48 hours at room temperature and normal pressure. Hydrochloric acid is added to remove calcium carbonate, and then washing with water, drying and classification are conducted to obtain a toner.

1.3 parts by weight of silicone oil-treated silicon oxide fine particles having an average particle diameter of 40 nm (RY50, produced by Nippon Aerosil Co., Ltd.), 2 parts by weight of deflagration silicon oxide fine particles having an average particle diameter of 100 nm (KMP-105, a classified product produced by Shin-Etsu Chemical Co., Ltd.) and 1.5 parts by weight of fine particles obtained by treating titanium oxide having an average particle diameter of 20 nm (MT150AW, produced by Tayca Corp.) with 20% of decyltrimethoxysilane are mixed with 100 parts by weight of the toner in a sample mill to produce a mixed toner.

EXAMPLE 3

100 parts by weight of C.I. Pigment Blue 15:4, 380 parts by weight of ethyl acetate and 20 parts by weight of Disparlon DA-703-50 (an acid amide amine salt of polyester, produced by Kusumoto Chemicals, Ltd.), from which a solvent has been removed, are dissolved and dispersed by using a DCP mill to produce a pigment dispersion.

30 parts by weight of paraffin wax (melting point: 89° C.) and 270 parts by weight of ethyl acetate are pulverized by a wet process under the condition cooled to 5° C. by using a DCP mill to produce a wax (releasing agent) dispersion.

428 parts by weight of a polyester resin formed from a bisphenol A propylene oxide adduct, bisphenol A ethylene oxide adduct and a terephthalic acid derivative (Mw: 50,000, Mn: 3,000, acid value: 15 mgKOH/g, hydroxyl group value: 27 mgKOH/g, Tg: 65° C., softening point: 112° C., mechanical tangent loss at 130° C.: 2.8), 113 parts by weight of the pigment dispersion, 250 parts by weight of wax dispersion, 25 parts by weight of hydrophobic silicon oxide fine particles (R816 produced by Aerosil Co., Ltd., average particle diameter: 7 nm) and 180 parts by weight of ethyl acetate are mixed and well agitated to become uniform (the liquid obtained is designated as a liquid A). Separately, 124 parts by weight of calcium carbonate dispersion formed by dispersing 40 parts by weight of calcium carbonate in 60 parts by weight of water, 99 parts by weight of a 2% aqueous solution of Celogen BS-H (produced by Dai-ichi Kogyo Seiyaku Co., Ltd.) and 157 parts by weight of water are agitated for 3 minutes by using a homogenizer (Ultra-Turrax, produced by IKA Works, Inc.) (the liquid obtained is designated as a liquid B).

345 parts by weight of the liquid B and 250 parts by weight of the liquid A are agitated at 10,000 rpm for 1 minute by using a homogenizer (Ultra-Turrax, produced by IKA Works, Inc.) to suspend the mixed solution, and then after adding 110 parts by weight of 0.3% aqueous ammonia, the solvent is removed by agitating with a propeller type agitator for 48 hours at room temperature and normal pressure. Hydrochloric acid is added to remove calcium carbonate, and then washing with water, drying and classification are conducted to obtain a toner.

1.3 parts by weight of silicone oil-treated silicon oxide fine particles having an average particle diameter of 40 nm (RY50, produced by Nippon Aerosil Co., Ltd.), 2 parts by weight of deflagration silicon oxide fine particles having an average particle diameter of 100 nm (KMP-105, a classified product produced by Shin-Etsu Chemical Co., Ltd.) and 1.5 parts by weight of fine particles obtained by treating titanium oxide having an average particle diameter of 20 nm (MT150AW, produced by Tayca Corp.) with 20% of decyltrimethoxysilane are mixed with 100 parts by weight of the toner in a DCP mill to produce a mixed toner.

EXAMPLE 4

75 parts by weight of C.I. Pigment Red 57:1, 406.3 parts by weight of ethyl acetate and 18.7 parts by weight of Disparlon DA-703-50 (an acid amide amine salt of polyester, produced by Kusumoto Chemicals, Ltd.), from which a solvent has been removed, are dissolved and dispersed by using a DCP mill to produce a pigment dispersion.

30 parts by weight of paraffin wax (melting point: 89° C.) and 270 parts by weight of ethyl acetate are pulverized by a wet process under the condition cooled to 5° C. by using a DCP mill to produce a wax (releasing agent) dispersion.

420 parts by weight of a polyester resin formed from a bisphenol A propylene oxide adduct, bisphenol A ethylene oxide adduct and a terephthalic acid derivative (Mw: 50,000, Mn: 3,000, acid value: 15 mgKOH/g, hydroxyl group value: 27 mgKOH/g, Tg: 65° C., softening point: 112° C., mechanical tangent loss at 130° C.: 2.8), 200 parts by weight of the pigment dispersion, 250 parts by weight of wax dispersion, 105 parts by weight of ethyl acetate and 20 parts by weight of hydrophobic silicon oxide fine particles (R972 produced by Aerosil Co., Ltd., average particle diameter: 16 nm) are mixed and well agitated to become uniform (the liquid obtained is designated as a liquid A). Separately, 124 parts by weight of calcium carbonate dispersion formed by dispersing 40 parts by weight of calcium carbonate in 60 parts by weight of water, 99 parts by weight of a 2% aqueous solution of Celogen BS-H (produced by Dai-ichi Kogyo Seiyaku Co., Ltd.) and 157 parts by weight of water are agitated for 3 minutes by using a homogenizer (Ultra-Turrax, produced by IKA Works, Inc.) (the liquid obtained is designated as a liquid B).

345 parts by weight of the liquid B and 250 parts by weight of the liquid A are agitated at 10,000 rpm for 1 minute by using a homogenizer (Ultra-Turrax, produced by IKA Works, Inc.) to suspend the mixed solution, and then after adding 110 parts by weight of 0.3% aqueous ammonia, the solvent is removed by agitating with a propeller type agitator for 48 hours at room temperature and normal pressure. Hydrochloric acid is added to remove calcium carbonate, and then washing with water, drying and classification are conducted to obtain a toner.

1.3 parts by weight of silicone oil-treated silicon oxide fine particles having an average particle diameter of 40 nm (RY50, produced by Nippon Aerosil Co., Ltd.), 2 parts by weight of deflagration silicon oxide fine particles having an average particle diameter of 100 nm (KMP-105, a classified product produced by Shin-Etsu Chemical Co., Ltd.) and 1.5 parts by weight of fine particles obtained by treating titanium oxide having an average particle diameter of 20 nm (MT150AW, produced by Tayca Corp.) with 20% of decyltrimethoxysilane are mixed with 100 parts by weight of the toner in a sample mill to produce a mixed toner.

EXAMPLE 5

75 parts by weight of C.I. Pigment Yellow 93, 412.4 parts by weight of ethyl acetate and 12.6 parts by weight of Disparlon DA-703-50 (an acid amide amine salt of polyester, produced by Kusumoto Chemicals, Ltd.), from which a solvent has been removed, are dissolved and dispersed by using a DCP mill to produce a pigment dispersion.

30 parts by weight of paraffin wax (melting point: 75° C.) and 270 parts by weight of ethyl acetate are pulverized by a wet process under the condition cooled to 5° C. by using a DCP mill to prepare a wax (releasing agent) dispersion.

367 parts by weight of a polyester resin formed from a bisphenol A propylene oxide adduct, bisphenol A ethylene oxide adduct and a terephthalic acid derivative (Mw: 50,000, Mn: 3,000, acid value: 15 mgKOH/g, hydroxyl group value: 27 mgKOH/g, Tg: 65° C., softening point: 112° C., mechanical tangent loss at 130° C.: 2.8), 376 parts by weight of the pigment dispersion, 235 parts by weight of wax dispersion and 24 parts by weight of hydrophobic silicon oxide fine particles (R972 produced by Aerosil Co., Ltd.) are mixed and well agitated to become uniform (the liquid obtained is designated as a liquid A). Separately, 124 parts by weight of calcium carbonate dispersion formed by dispersing 40 parts by weight of calcium carbonate in 60 parts by weight of water by using dynomill, 99 parts by weight of a 2% aqueous solution of Celogen BS-H (produced by Dai-ichi Kogyo Seiyaku Co., Ltd.) and 157 parts by weight of water are agitated for 3 minutes by using a homogenizer (Ultra-Turrax, produced by IKA Works, Inc.) (the liquid obtained is designated as a liquid B).

345 parts by weight of the liquid B and 250 parts by weight of the liquid A are agitated at 10,000 rpm for 1 minute by using a homogenizer (Ultra-Turrax, produced by IKA Works, Inc.) to suspend the mixed solution, and then after adding 110 parts by weight of 0.3% aqueous ammonia, the solvent is removed by agitating with a propeller type agitator for 48 hours at room temperature and normal pressure. Hydrochloric acid is added to remove calcium carbonate, and then washing with water, drying and classification are conducted to obtain a toner.

1.3 parts by weight of silicone oil-treated silicon oxide fine particles having an average particle diameter of 40 nm (RY50, produced by Nippon Aerosil Co., Ltd.), 2 parts by weight of deflagration silicon oxide fine particles having an average particle diameter of 100 nm (KMP-105, a classified product produced by Shin-Etsu Chemical Co., Ltd.) and 1.5 parts by weight of fine particles obtained by treating titanium oxide having an average particle diameter of 20 nm (MT150AW, produced by Tayca Corp.) with 16% of decyltrimethoxysilane are mixed with 100 parts by weight of the toner in a sample mill to produce a mixed toner.

EXAMPLE 6

A toner is prepared in the same manner as in Example 4 except that C.I. Pigment Red 122 is used instead of C.I. Pigment Red 57:1.

EXAMPLE 7

A toner is prepared in the same manner as in Example 4 except that C.I. Pigment Red 185 is used instead of C.I. Pigment Red 57:1.

EXAMPLE 8

A toner is prepared in the same manner as in Example 3 except that such a pigment dispersion is used that is produced by dissolving and dispersing, by using a DCP mill, 100 parts by weight of C.I. Pigment Blue 15:3, 4 parts by weight of Solsperse 5000 (produced by Zeneca, Ltd.), 380 parts by weight of ethyl acetate and 20 parts by weight of Disparlon DA-703-50 (an acid amide amine salt of polyester, produced by Kusumoto Chemicals, Ltd.), from which a solvent has been removed.

COMPARATIVE EXAMPLE 1

A toner is prepared in the same manner as in Example 1 except that the hydrophobic silicon oxide fine particles are not used.

COMPARATIVE EXAMPLE 2

A toner is prepared in the same manner as in Example 1 except that the wax (releasing agent) dispersion is produced by pulverization by a wet process under the condition cooled to 10° C. by using a DCP mill.

COMPARATIVE EXAMPLE 3

A toner is prepared in the same manner as in Example 1 except that 345 parts by weight of the liquid B and 250 parts by weight of the liquid A are agitated at 10,000 rpm for 1 minute under cooling to 5° C. by using a homogenizer, and the resulting mixed liquid is suspended.

COMPARATIVE EXAMPLE 4

A toner is prepared in the same manner as in Example 1 except that 345 parts by weight of the liquid B and 250 parts by weight of the liquid A are agitated at 10,000 rpm for 1 minute at 40° C. by using a homogenizer, and the resulting mixed liquid is suspended.

EVALUATION

The toners obtained in Examples 1 to 8 and Comparative Examples 1 to 4 are measured and evaluated for the conglobation degree, the average particle diameter, the maximum value of the mechanical tangent loss of dynamic viscoelasticity at a temperature of from 130 to 190° C., the OHP transmittance and the fixing property. The average particle diameter and the major diameter/minor diameter ratio of the paraffin wax (releasing agent) in the toner are also measured. The evaluation methods are as follows. The results are shown in Table 1.

Average Particle Diameter and Major Diameter/Minor Diameter Ratio of Paraffin Wax (Releasing Agent)

The average particle diameter and the major diameter/minor diameter ratio of releasing agent are measured in the same manner as described in the foregoing.

Conglobation Degree, Average Particle Diameter and Maximum Value of Mechanical Tangent Loss of Dynamic Viscoelasticity at a Temperature of 130 to 190° C.

The conglobation degree, the average particle diameter and the maximum value of the mechanical tangent loss of dynamic viscoelasticity at a temperature of 130 to 190° C. are measured in the same manner as described in the foregoing.

OHP Transmittance

The OHP transmittance is evaluated in such a manner that a toner image is formed on an OHP sheet by using a modified machine of A-color 935 (produced by Fuji Xerox Co., Ltd.), and the transmittance is observed by naked eye.

Fixing Property

The fixing property is evaluated by investigating presence or absence of involution on a fixing device by using a modified machine of A-color 935 (produced by Fuji Xerox Co., Ltd.) that is in such a condition that no oil is supplied, and a peeling finger for forced peeling is not attached. For the evaluation, the carrier for A-color 935 having a resin coating layer is used.

TABLE 1

| | Pigment | Inorganic fine particles (internal addition) | Average particle diameter of releasing agent (μm) | Major diameter/minor diameter ratio of releasing agent | Maximum value of mechanical tangent loss at 130° C. of binder resin | Maximum value of mechanical tangent loss at 130 to 190° C. of toner | Conglobation degree of toner | Average particle diameter of toner (μm) | OHP transmittance | Involution on fixing roll |
|---|---|---|---|---|---|---|---|---|---|---|
| Example 1 | C.I. Pigment Yellow 180 | Aerosil R972 | 0.6 | 4.0 | 2.8 | 1.6 | 120 | 7.5 | clear yellow | none |
| Example 2 | Carbon Black | Aerosil R812 | 0.5 | 2.2 | 2.8 | 0.9 | 117 | 7.5 | — | none |
| Example 3 | C.I. Pigment Blue 15:4 | Aerosil R976 | 0.5 | 2.5 | 2.8 | 0.8 | 121 | 7.5 | clear blue | none |
| Example 4 | C.I. Pigment | Aerosil R972 | 0.5 | 4.3 | 2.8 | 1.5 | 120 | 7.5 | clear red | none |

TABLE 1-continued

| | Pigment | Inorganic fine particles (internal addition) | Average particle diameter of releasing agent (μm) | Major diameter/minor diameter ratio of releasing agent | Maximum value of mechanical tangent loss at 130° C. of binder resin | Maximum value of mechanical tangent loss at 130 to 190° C. of toner | Conglobation degree of toner | Average particle diameter of toner (μm) | OHP transmittance | Involution on fixing roll |
|---|---|---|---|---|---|---|---|---|---|---|
| | Red 57:1 | | | | | | | | | |
| Example 5 | C.I. Pigment Yellow 93 | Aerosil R972 | 0.6 | 4.0 | 2.8 | 1.6 | 118 | 7.5 | clear yellow | none |
| Example 6 | C.I. Pigment Red 122 | Aerosil R972 | 0.5 | 3.5 | 2.8 | 1.4 | 123 | 7.5 | clear red | none |
| Example 7 | C.I. Pigment Red 185 | Aerosil R972 | 0.5 | 3.3 | 2.8 | 1.4 | 121 | 7.5 | clear red | none |
| Example 8 | C.I. Pigment Blue 15:3 | Aerosil R972 | 0.5 | 2.5 | 2.8 | 1 | 117 | 7.5 | clear blue | none |
| Comparative Example 1 | C.I. Pigment Yellow 180 | — | 0.6 | 4.1 | 2.8 | 2.7 | 118 | 7.5 | dark yellow | present |
| Comparative Example 2 | C.I. Pigment Yellow 180 | Aerosil R972 | 1.2 | 2.1 | 2.8 | 1.6 | 120 | 7.5 | dark yellow | none |
| Comparative Example 3 | C.I. Pigment Yellow 180 | Aerosil R972 | 0.7 | 1.0 | 2.8 | 1.6 | 120 | 7.5 | clear yellow | present |
| Comparative Example 4 | C.I. Pigment Yellow 180 | Aerosil R972 | 0.9 | 11 | 2.8 | 1.6 | 122 | 7.5 | dark yellow | none |

It is understood from Table 1 that the toners of Examples 1 to 8 are excellent in OHP transmittance and also excellent in coloring property. It is also understood from the excellent fixing property that they can be easily released from the fixing device.

As described in the foregoing, the invention provides an electrophotographic toner excellent in coloring property, fixing property, OHP transmittance and charging property, a process for producing the same, and a two-component developer.

The entire disclosure of Japanese Patent Application No. 2000-121160 filed on Apr. 21, 2000 including specification, claims and abstract is incorporated herein by reference in its entirety.

What is claimed is:

1. An electrophotographic toner comprising a binder resin, a colorant, a releasing agent and inorganic fine particles, the toner having a conglobation degree of from about 100 to about 130, the releasing agent having an average particle diameter of from about 0.1 to about 1 μm and a ratio of a major axis and a minor axis of from about 1.1 to about 10, and the inorganic fine particles being dispersed in the toner particles.

2. An electrophotographic toner as claimed in claim 1, wherein the binder resin has a mechanical tangent loss (tan δ) of dynamic viscoelasticity of from 1.8 to 3.3 at an angular velocity of 100 rad/sec and a temperature of 130° C.

3. An electrophotographic toner as claimed in claim 1, wherein the colorant has been subjected to a surface treatment.

4. An electrophotographic toner as claimed in claim 1, wherein the releasing agent has a melting point of from 50 to 110° C.

5. An electrophotographic toner as claimed in claim 1, wherein the content of the releasing agent is from about 0.5 to about 10 parts by weight per 100 parts by weight of the binder resin.

6. An electrophotographic toner as claimed in claim 1, wherein the inorganic fine particles have an average particle diameter of from 4 to 500 nm.

7. An electrophotographic toner as claimed in claim 1, wherein the internal content of the inorganic fine particles is from 1 to 20 parts by weight per 100 parts by weight of the toner.

8. An electrophotographic toner as claimed in claim 1, wherein the toner has a maximum value of a mechanical tangent loss (tan δ) of dynamic viscoelasticity of 2.1 or less at an angular velocity of 100 rad/sec and a temperature of from 130 to 190° C.

9. A process for preparing the electrophotographic toner as claimed in claim 1, the process comprising:

mixing a binder resin, a colorant, a releasing agent and inorganic fine particles in an organic solvent that dissolves the binder resin to prepare an oleophilic component;

suspending the oleophilic component in an aqueous medium and forming into particles, to prepare a suspension; and removing the organic solvent from the suspension.

10. A process for preparing the electrophotographic toner as claimed in claim 9, wherein the inorganic fine particles have an average particle diameter of from 4 to 500 nm.

11. A process for preparing the electrophotographic toner as claimed in claim 9, wherein the internal content of the inorganic fine particles is from 1 to 20 parts by weight per 100 parts by weight of the toner.

12. A process for preparing the electrophotographic toner as claimed in claim 9, wherein the content of the releasing agent is from about 0.5 to about 10 parts by weight per 100 parts by weight of the binder resin.

13. A process for preparing the electrophotographic toner as claimed in claim 9, wherein the binder resin has a mechanical tangent loss (tan δ) of dynamic viscoelasticity of from 1.8 to 3.3 at an angular velocity of 100 rad/sec and a temperature of 130° C.

14. A process for preparing the electrophotographic toner as claimed in claim 9, wherein the toner has a maximum value of a mechanical tangent loss (tan δ) of dynamic viscoelasticity of 2.1 or less at an angular velocity of 100 rad/sec and a temperature of from 130 to 190° C.

15. A two-component developer comprising a carrier and a toner, the electrophotographic toner comprising a binder resin, a colorant, a releasing agent and inorganic fine particles, the toner having a conglobation degree of from about 100 to about 130, and the releasing agent having an average particle diameter of from about 0.1 to about 1 μm and a ratio of a major axis and a minor axis of from about 1.1 to about 10, and the inorganic fine particles being dispersed in the toner particles.

16. A two-component developer as claimed in claim 15, wherein the carrier has a resin coating layer.

17. A process for forming an image, comprising forming an electrostatic latent image on an electrostatic holding member, developing the electrostatic latent image with a developer layer on a developer holding member to form a toner image, transferring the toner image to a receiving member, and fixing the toner image, the toner comprising a binder resin, a colorant, a releasing agent and inorganic fine particles, the toner having a conglobation degree of about from 100 to 130, the releasing agent having an average particle diameter of about from 0.1 to 1 μm and a ratio of a major axis and a minor axis of about from 1.1 to 10, and the inorganic fine particles being dispersed in the toner particles.

* * * * *